US006375239B1

(12) United States Patent
Reed et al.

(10) Patent No.: US 6,375,239 B1
(45) Date of Patent: Apr. 23, 2002

(54) HANDLE ATTACHMENT FOR A BOX

(76) Inventors: Darrell W. Reed; Grace W. Reed, 4835 W. College Ave. #134, both of Greendale, WI (US) 53129

( * ) Notice: Subject to any disclaimer, the term of this patent is extended or adjusted under 35 U.S.C. 154(b) by 0 days.

(21) Appl. No.: 09/621,974

(22) Filed: Jul. 21, 2000

(51) Int. Cl.[7] ..... B65D 5/46
(52) U.S. Cl. ..... 294/27.1; 229/117.23
(58) Field of Search ..... 294/1.1, 27.1, 294/137, 149; 229/117.09, 117.19, 117.23, 117.26; D9/434

(56) References Cited

U.S. PATENT DOCUMENTS

| | | | | | |
|---|---|---|---|---|---|
| 1,492,100 | A | | 4/1924 | Krueger | 294/270.1 |
| 1,505,594 | A | | 8/1924 | Gruenberg | 229/117.09 |
| 1,524,399 | A | * | 1/1925 | Krueger | 294/27.1 |
| 1,722,052 | A | * | 7/1929 | Lackey | 294/149 |
| 2,069,459 | A | * | 2/1937 | Neubronner | 229/117.23 |
| 2,158,697 | A | | 5/1939 | Harrison | 229/117.23 |
| 2,194,232 | A | * | 3/1940 | Peters | 294/27.1 |
| 2,458,173 | A | | 1/1949 | Kardon | 229/117.09 |
| 2,846,134 | A | * | 8/1958 | Moubayed | 294/27.1 |
| 3,031,359 | A | * | 4/1962 | Blank et al. | 294/27.1 |
| 3,206,104 | A | * | 9/1965 | Cohen | 229/117.23 |
| 3,383,029 | A | * | 5/1968 | Reade | 229/117.23 |
| 3,655,121 | A | * | 4/1972 | Ward | 229/92.8 |
| 4,471,870 | A | * | 9/1984 | Uhlig | 229/117.23 |
| D294,559 | S | | 3/1988 | Schwalbach | D9/434 |
| 5,419,009 | A | * | 5/1995 | Assis et al. | 229/117.26 |
| 5,680,977 | A | * | 10/1997 | Burke | 229/117.26 |
| 5,876,081 | A | | 3/1999 | Melody et al. | 294/27.1 |

* cited by examiner

*Primary Examiner*—Eileen D. Lillis
*Assistant Examiner*—Paul T. Chin

(57) ABSTRACT

A handle attachment for a box for providing a convenient and easy way of carrying boxes with no handles. The handle attachment for a box includes a piece of rigid material being essentially flat and having rounded corners with the piece of rigid material further having a front layer and a back layer and with each of the front and back layers having an upper portion and a lower portion with a laterally-extending slot disposed through the upper portions of the front and back layers; and also includes adhesive being applied to the lower portions of the front and back layers of the piece of rigid material with the adhesive being protected with peel-away backing material for securely fastening the piece of rigid material to a box.

7 Claims, 2 Drawing Sheets

HANDLE ATTACHMENT FOR A BOX

BACKGROUND OF THE INVENTION

1. Field of the Invention

The present invention relates to a box handle and more particularly pertains to a new handle attachment for a box for providing a convenient and easy way of carrying boxes with no handles.

2. Description of the Prior Art

The use of a box handle is known in the prior art. More specifically, a box handle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,876,081; 1,505,594; 2,158,697; 1,492,100; 2,458,173; and U.S. Patent No. Des. 294,559.

While these devices fulfill their respective, particular objectives and requirements, the aforementioned patents do not disclose a new handle attachment for a box. The inventive device includes a piece of rigid material being essentially flat and having rounded corners with the piece of rigid material further having a front layer and a back layer and with each of the front and back layers having an upper portion and a lower portion with a laterally-extending slot disposed through the upper portions of the front and back layers; and also includes adhesive being applied to the lower portions of the front and back layers of the piece of rigid material with the adhesive being protected with peel-away backing material for securely fastening the piece of rigid material to a box.

In these respects, the handle attachment for a box according to the present invention substantially departs from the conventional concepts and designs of the prior art, and in so doing provides an apparatus primarily developed for the purpose of providing a convenient and easy way of carrying boxes with no handles.

SUMMARY OF THE INVENTION

In view of the foregoing disadvantages inherent in the known types of box handle now present in the prior art, the present invention provides a new handle attachment for a box construction wherein the same can be utilized for providing a convenient and easy way of carrying boxes with no handles.

The general purpose of the present invention, which will be described subsequently in greater detail, is to provide a new handle attachment for a box which has many of the advantages of the box handle mentioned heretofore and many novel features that result in a new handle attachment for a box which is not anticipated, rendered obvious, suggested, or even implied by any of the prior art box handle, either alone or in any combination thereof.

To attain this, the present invention generally comprises a piece of rigid material being essentially flat and having rounded corners with the piece of rigid material further having a front layer and a back layer and with each of the front and back layers having an upper portion and a lower portion with a laterally-extending slot disposed through the upper portions of the front and back layers; and also includes adhesive being applied to the lower portions of the front and back layers of the piece of rigid material with the adhesive being protected with peel-away backing material for securely fastening the piece of rigid material to a box.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handle attachment for a box which has many of the advantages of the box handle mentioned heretofore and many novel features that result in a new handle attachment for a box which is not anticipated, rendered obvious, suggested, or even implied by any of the prior art box handle, either alone or in any combination thereof.

It is another object of the present invention to provide a new handle attachment for a box which may be easily and efficiently manufactured and marketed.

It is a further object of the present invention to provide a new handle attachment for a box which is of a durable and reliable construction.

An even further object of the present invention is to provide a new handle attachment for a box which is susceptible of a low cost of manufacture with regard to both materials and labor, and which accordingly is then susceptible of low prices of sale to the consuming public, thereby making such handle attachment for a box economically available to the buying public.

Still yet another object of the present invention is to provide a new handle attachment for a box which provides in the apparatuses and methods of the prior art some of the advantages thereof, while simultaneously overcoming some of the disadvantages normally associated therewith.

Still another object of the present invention is to provide a new handle attachment for a box for providing a convenient and easy way of carrying boxes with no handles.

Yet another object of the present invention is to provide a new handle attachment for a box which includes a piece of rigid material being essentially flat and having rounded corners with the piece of rigid material further having a front layer and a back layer and with each of the front and back layers having an upper portion and a lower portion with a laterally-extending slot disposed through the upper portions of the front and-back layers; and also includes adhesive being applied to the lower portions of the front and back layers of the piece of rigid material with the adhesive being protected with peel-away backing material for securely fastening the piece of rigid material to a box.

Still yet another object of the present invention is to provide a new handle attachment for a box that makes it much easier to carry boxes.

Even still another object of the present invention is to provide a new handle attachment for a box that can be easily and quickly attached to boxes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
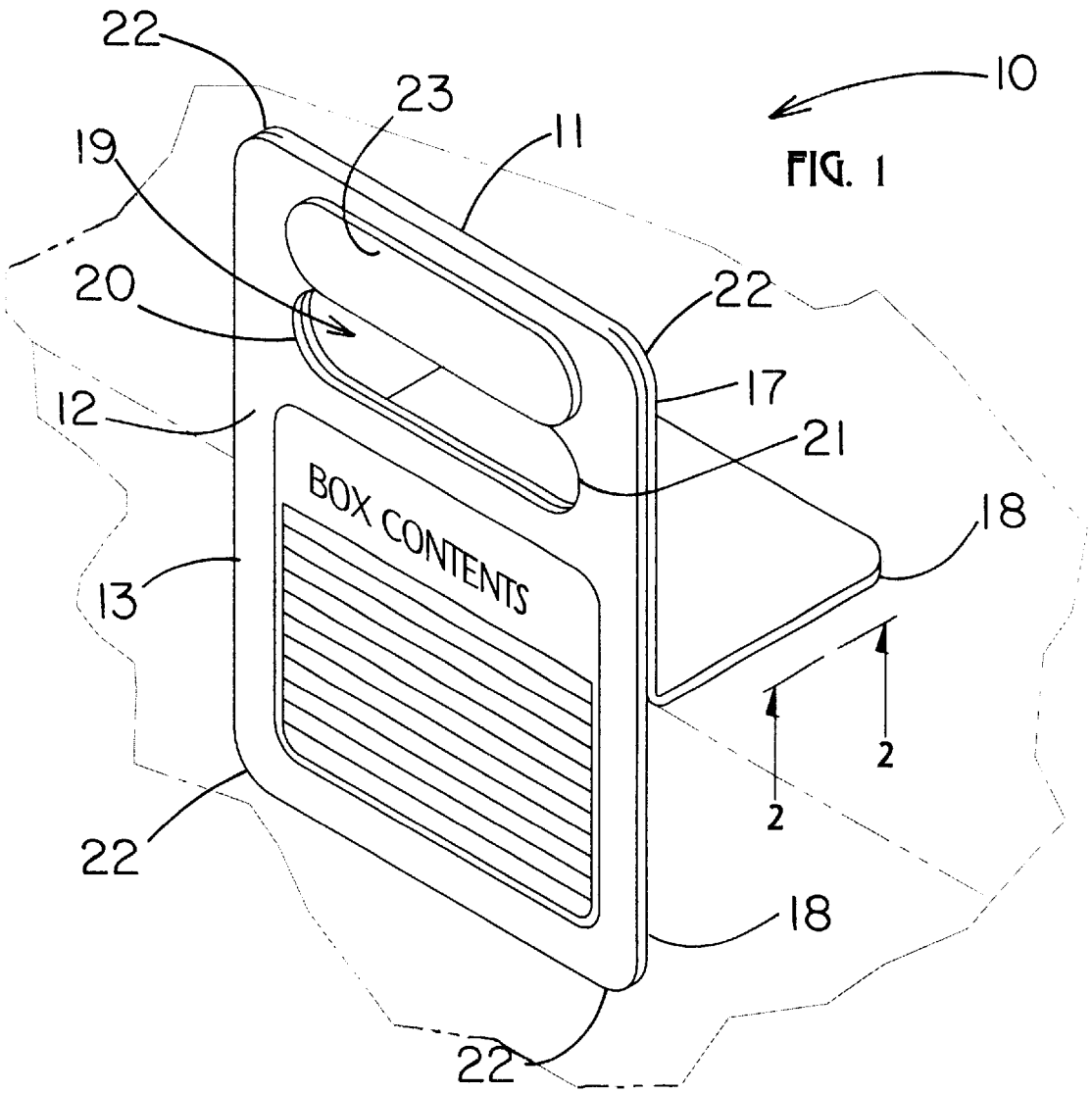
FIG. 1 is a perspective view of a new handle attachment for a box according to the present invention.
Figure 2:
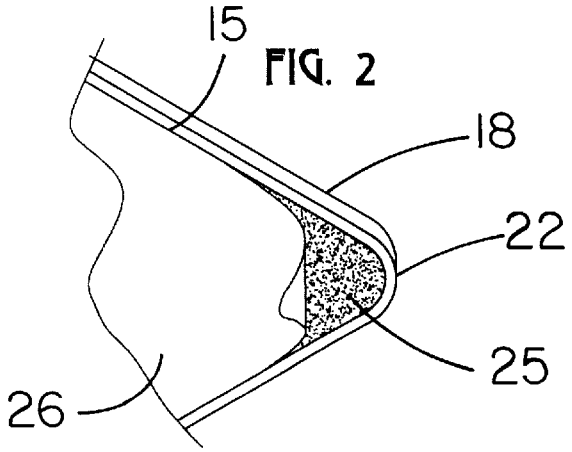
FIG. 2 is a partial perspective view of a corner of the sheet of material of the present invention.
Figure 3:
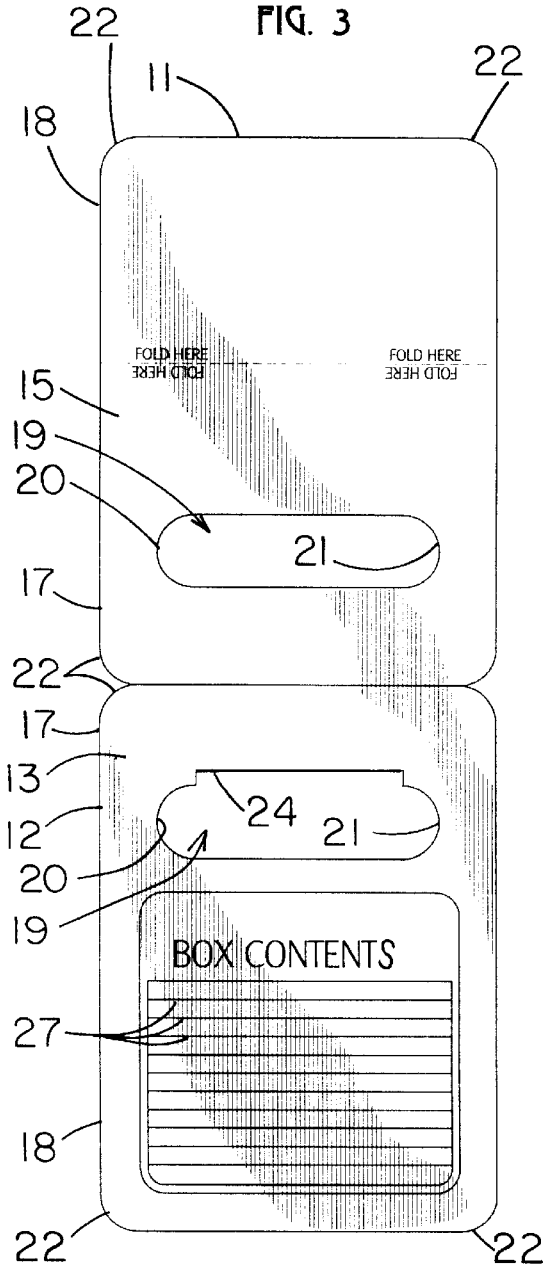
FIG. 3 is a front side elevational view of the present invention.
Figure 4:
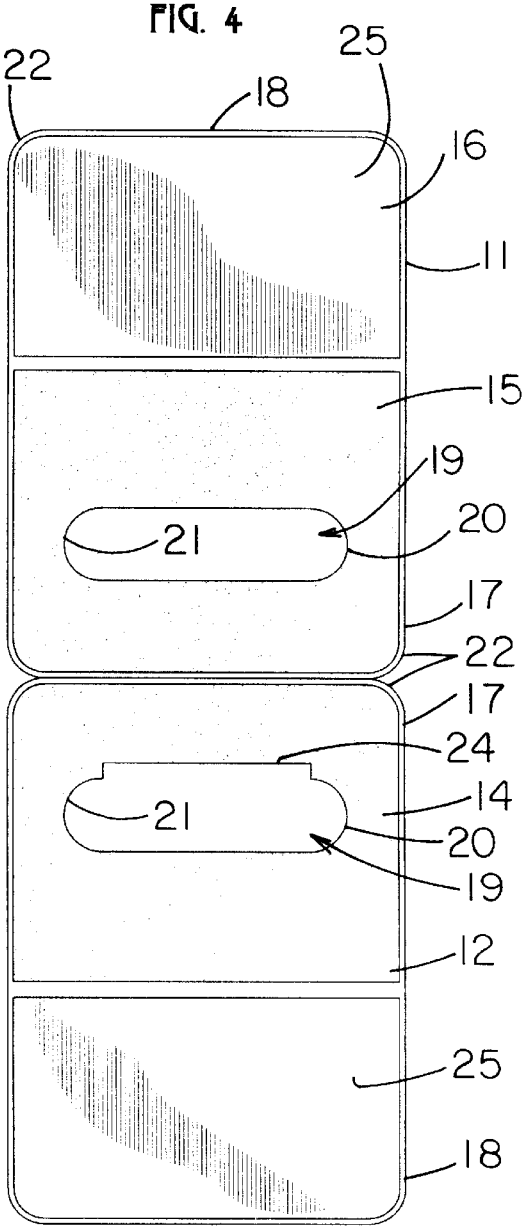
FIG. 4 is a rear side elevational view of the present invention.

With reference now to the drawings, and in particular to FIGS. 1 through 4 thereof, a new handle attachment for a box embodying the principles and concepts of the present invention and generally designated by the reference numeral 10 will be described.

As best illustrated in FIGS. 1 through 4, the handle attachment for a box 10 generally comprises a piece of rigid material 11 being essentially flat and having rounded corners 22 with the piece of rigid material 11 further having a front layer 12 and a back layer 15, each of the front and back layers 12,15 having an upper portion 17 and a lower portion 18 with a laterally-extending slot disposed 19 through the upper portions 17 of the front and back layers 12,15. The back layer 15 of the piece of rigid material 11 has a crease extending laterally thereof and essentially separating the upper portion 17 from the lower portion 18 thereof. The lower portion 18 of the front layer 12 has a front side 13 and a back side 14, and the lower portion 18 of the back layer 15 has an underside 16. The lower portion 18 of the back layer 15 is foldable outwardly relative to the front layer 12 and to the upper portion 17 of the back layer 15. The piece of rigid material 11 includes a flap member 23 being foldably attached along a top edge 24 forming the laterally-extending slot 19 with the flap member 23 being foldable upon the back layer 15 of the piece of rigid material 11. The piece of rigid material 11 includes rounded ends 20,21 forming the laterally-extending slot 19. The piece of rigid material 11 also includes a plurality of spaced lines 27 being disposed upon a front side 13 of the front layer 12 and being adapted to be written upon to identify contents of the box to which the piece of rigid material 11 is securely attached. The piece of material 11 is approximately 15 inches long and approximately 5¼ inches wide with the laterally-extending slot 19 being approximately 3¾ long and approximately 1 inch wide with the rounded ends 20,21 having a radius of approximately ½ inch and being adapted to receive a user's hand.

Adhesive 25 is conventionally applied to the lower portions 18 of the front and back layers 12,15 of the piece of rigid material 11 with the adhesive 25 being protected with peel-away backing material 26 for securely fastening the piece of rigid material 11 to the box. The adhesive 25 is applied to the underside 16 of the lower portion 18 of the back layer 15 and is applied to the back side 14 of the lower portion 18 of the front layer 12 with the peel-away backing material 26 being removably disposed over the adhesive 25.

In use, the user folds the flap member 23 upon the back layer 15 of the piece of rigid material 11 and also folds the lower portion 18 of the back layer 15 outwardly relative to the front layer 12 and then removes the peel-away backing material 26 from upon the underside 16 of the lower portion 18 of the back layer 15 and the back side 14 of the lower portion 18 of the front layer 12 and adheres the lower portions 18 of the front layer 12 and the back layer 15 to the box to enable the user to lift and carry the box by grasping the portion of the piece of rigid material 11 above the laterally-extending slot 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A handle attachment for coupling to a top and side surfaces of a box comprising:

a piece of rigid material being essentially flat and having rounded corners, said piece of rigid material further having a front layer and a back layer, each of said front and back layers having an upper portion and a lower portion with a laterally-extending slot disposed through said upper portions of said front and back layers for receiving a user's hand, wherein said back layer of said piece of rigid material has a crease extending laterally thereof and essentially separating said upper portion from said lower portion thereof such that when said lower portion of said back layer is folded along said crease said front layer of said rigid material is oriented perpendicularly to said lower portion of said back layer;

an adhesive being applied to said lower portions of said front and back layers of said piece of rigid material with said adhesive being protected with peel-away backing material for securely fastening said piece of rigid material to a box; and wherein said piece of rigid material includes a plurality of spaced lines being disposed upon a front side of said front layer and being adapted to be written upon to identify contents of the box to which said piece of rigid material is securely attached.

2. A handle attachment for a box as described in claim 1, wherein said lower portion of said front layer has a front side and a back side, and said lower portion of said back layer has an underside.

3. A handle attachment for a box as described in claim 2, wherein said adhesive is applied to said underside of said lower portion of said back layer and is applied to said back side of said lower portion of said front layer with said peel-away backing material being removably disposed over said adhesive such that said lower portion of said back layer is positionable along said top surface of said box and said back side of said lower portion of said front layer is positionable along said side surface of said box when said lower portion of said back layer is folded along said crease.

4. A handle attachment for a box as described in claim 1, wherein said lower portion of said back layer is foldable outwardly relative to said front layer and to said upper portion of said back layer.

5. A handle attachment for a box as described in claim 1, wherein said piece of rigid material includes a flap member being foldably attached along a top edge forming a laterally-extending slot, said flap member being foldable upon said back layer of said piece of rigid material.

6. A handle attachment for a box as described in claim 5, wherein said piece of rigid material includes rounded ends forming said laterally-extending slot.

7. A handle attachment for a box comprising:

a piece of rigid material being essentially flat and having rounded corners, said piece of rigid material further having a front layer and a back layer, each of said front and back layers having an upper portion and a lower portion with a laterally-extending slot disposed through said upper portions of said front and back layers for receiving a user's hand, said back layer of said piece of rigid material having a crease extending laterally thereof and essentially separating said upper portion from said lower portion thereof such that when said lower portion of said back layer is folded along said crease said front layer of said rigid material is oriented perpendicularly to said lower portion of said back layer, said lower portion of said front layer having a front side and a back side, and said lower portion of said back layer has an underside, said lower portion of said back layer being foldable outwardly relative to said front layer and to said upper portion of said back layer, said piece of rigid material including a flap member being foldably attached along a top edge forming said laterally-extending slot, said flap member being foldable upon said back layer of said piece of rigid material, said piece of rigid material including rounded ends forming said laterally-extending slot, said piece of rigid material including a plurality of spaced lines being disposed upon a front side of said front layer and being adapted to be written upon to identify contents of the box to which said piece of rigid material is securely attached, said piece of material being approximately 15 inches long and approximately 5¼ inches wide, said laterally-extending slot being approximately 3¾ long and approximately 1 inch wide with said rounded ends having a radius of approximately ½ inch; and adhesive being applied to said lower portions of said front and back layers of said piece of rigid material with said adhesive being protected with peel-away backing material for securely fastening said piece of rigid material to a box, said adhesive being applied to said underside of said lower portion of said back layer and being applied to said back side of said lower portion of said front layer with said peel-away backing material being removably disposed over said adhesive such that said lower portion of said back layer is positionable along said top surface of said box and said back side of said lower portion of said front layer is positionable along said side surface of said box when said lower portion of said back layer is folded along said crease.

* * * * *